US005660339A

United States Patent [19]

Scott et al.

[11] Patent Number: 5,660,339

[45] Date of Patent: Aug. 26, 1997

[54] ROTARY GRINDING MILL

[75] Inventors: Leon Scott, Sandy; Leslie L. Black, Salt Lake City, both of Utah

[73] Assignee: Creative Technologies, Salt Lake City, Utah

[21] Appl. No.: 315,232

[22] Filed: Sep. 29, 1994

[51] Int. Cl.[6] ..... B02C 7/04; B02C 7/13; B02C 13/24

[52] U.S. Cl. ..... 241/60; 241/79.1; 241/100; 241/188.2; 241/186.4; 241/DIG. 30

[58] Field of Search ..... 241/8, 12, 49, 241/57, 60, 62, 79.1, 100, 188.2, 186.2, 186.4, DIG. 30, 245, 248, 261, 261.3

[56] References Cited

U.S. PATENT DOCUMENTS

| | | | |
|---|---|---|---|
| D. 261,517 | 10/1981 | Dickson Jr. . | |
| 2,556,641 | 6/1951 | Bakewell | 241/215 |
| 2,639,901 | 5/1953 | Teale | 241/188.2 X |
| 2,743,875 | 5/1956 | Brezosky et al. | 241/DIG. 30 X |
| 2,879,949 | 5/1959 | Jordan | 241/DIG. 30 X |
| 2,973,095 | 2/1961 | Anderson et al. | 241/DIG. 30 X |
| 3,488,008 | 1/1970 | Bodine | 241/100 X |
| 4,060,206 | 11/1977 | Granzow | 241/261.3 X |
| 4,203,555 | 5/1980 | Dickson Jr. . | |
| 4,422,578 | 12/1983 | Scott . | |
| 4,759,508 | 7/1988 | Griffith | 241/100 X |
| 4,971,261 | 11/1990 | Solomons | 241/100 X |

FOREIGN PATENT DOCUMENTS

| | | |
|---|---|---|
| 1648553 | 5/1991 | Russian Federation . |

*Primary Examiner*—Timothy V. Eley
*Attorney, Agent, or Firm*—Thorpe, North & Western

[57] ABSTRACT

A rotary grinding mill is disclosed including a hopper for holding a product to be milled, a mixing chamber having a grain inlet and a separate air inlet for mixing grain and air prior to grinding, a grinding mechanism for grinding the grain and a discharge port for disposing of grain flour received from the grinding mechanism. Connected to the discharge port is a container separate from the grinding mill which may be used not only to collect ground product, but also to store the ground product for later use. In accordance with one aspect of the invention, the container is connected to the grinding mechanism by an arcuate connector for developing a helical flow path of air within the container. In accordance with another aspect of the invention, a motor which drives the grinding mechanism, and a rotor of the grinding mechanism, are structurally isolated from the grinding mill so as to minimize vibration and noise within the grinding mill.

42 Claims, 4 Drawing Sheets

ROTARY GRINDING MILL

BACKGROUND OF THE INVENTION

The invention relates to a rotary grinding mill for milling foodstuffs, such as grain and the like, and more specifically, to a mill providing improved control, handling and noise reduction during the grinding process.

There are currently numerous grinding mills available on the market for grinding foodstuffs into smaller particles. One very common use of these mills is to grind wheat into flour for the making of homemade bread, biscuits and other bakery items. Two popular such mills are disclosed in U.S. Pat. No. 4,203,555 and U.S. Pat. No. 4,422,578. Each of these patents disclose grinding mills which have a vertically disposed grinding mechanism consisting of a generally stationary stator and a rotatable rotor. A plurality of teeth extend horizontally from the stator and the rotor such that the food product being ground passed between the stator and the rotor are chopped or broken in to numerous smaller pieces by the teeth.

In Dickson, U.S. Pat. No. 4,203,555, the ground food product passes through the teeth, and is driven in a generally linear path into a collection pan. Such an arrangement, however, causes two significant problems. First, the product accumulates unevenly so that most of the product is disposed beneath the grinding mechanism. The product will eventually reach an uneven height at which the collection pan must be removed. With this arrangement, the necessity of removing the collection pan is increased because the product is not uniformly distributed within the collection pan.

Second, the linear path also continually agitates the product in the collection pan as air continually passes over the ground product and causes minute particles to be suspended in the air. Eventually, these particles must be removed from the air before it is exhausted from the mill.

In Scott, U.S. Pat. No. 4,422,578, an improvement was made by forcing the ground product to follow a radial path, thereby decreasing agitation of the product in the collection pan, and causing a greater amount of particulate content to be released by the air. Scott and Dickson both further reduced the amount of particulate which must be filtered by providing an exhaust mechanism which develops an upward helical movement in the exhaust air. With both of these arrangements, however, a significant quantity of minute food stuff particles is still carried upward into a filter which must remove the particles.

Additional concerns with both of these mills, and other mills presently available, are the unsatisfactory level of control between fine and rough grinding, as well as the considerable noise which develops during grinding. With respect to the grinding, currently available machines generally provide fine and rough grinding with varying intermediate degrees of coarseness. Because different levels of flour coarseness are used for different kinds of baking, i.e. breads, rolls, etc., the presently available home grinding mills are often not suitable for the needs of consumers who desire more control.

An additional concern with most mills purchased for home use is the excessive vibration and noise which the mill creates during grinding. As the teeth on the stator and rotor grind the wheat, a considerable amount of vibrational energy and noise is transferred through the mill casing to the counter, etc., on which the mill is placed. When the mills are used for long periods of time, the noise and vibration can become considerably annoying to those using the mills and others in the near vicinity.

In light of these concerns, there is a need for a grinding mill which enhances overall performance, decreases the amount of fine food product particulates which must be filtered from the air, and decreases the noise and vibrational energy typically associated with home grinding mills.

OBJECTS OF THE INVENTION

It is an object of the present invention to provide a grinding mill having an adjustable air and product intake for regulating particle size and the speed at which the product is fed into the grinder.

It is another object of the present invention to provide a grinding mill wherein the finished product accumulates in a storage container separate from the grinding mill.

It is an additional object of the present invention to provide a grinding mill which decreases the amount of fine particulates of the product accumulating on the exhaust filter.

It is yet another object of the present invention to provide a grinding mill with improved control of product particulate size.

It is yet another object of the invention to provide a grinding mill which is substantially quieter and produces less vibration than those of the present art.

The above noted objects of the invention are realized in a specific illustrative embodiment of a grinding mill including a feed means for holding a product to be milled, mixing means for combining the product to be milled with a selectable amount of air in connection with a grinding mechanism so as to control the amount of product entering the grinding mechanism, as well as the speed at which the product passes through the grinding mechanism. The invention also includes a collection means for receiving ground product and filtering exhaust air carrying fine particulates of the ground product so as to prevent particulate containing exhaust air from exiting the grinding mill/collection means.

In accordance with one aspect of the invention, the collection means is formed by a container separate from the grinding mill which may be used not only to collect ground food product, but also to store the ground food product for later use.

In accordance with another aspect of the invention, the collection means is connected to the grinding means by an arcuate connector for developing a helical flow path of air within the collection means.

In accordance with yet another aspect of the invention, a motor which drives the grinding mechanism, and a rotor of the grinding mechanism, are structurally isolated by resilient attachment means from the grinding mill so as to minimize vibration and noise within the grinding mill.

BRIEF DESCRIPTION OF THE DRAWINGS

The above and other objects, features and advantages of the invention will become apparent from a consideration of the following detailed descriptions presented in conjunction with the accompanying drawings in which.

DETAILED DESCRIPTION

Figure 1:
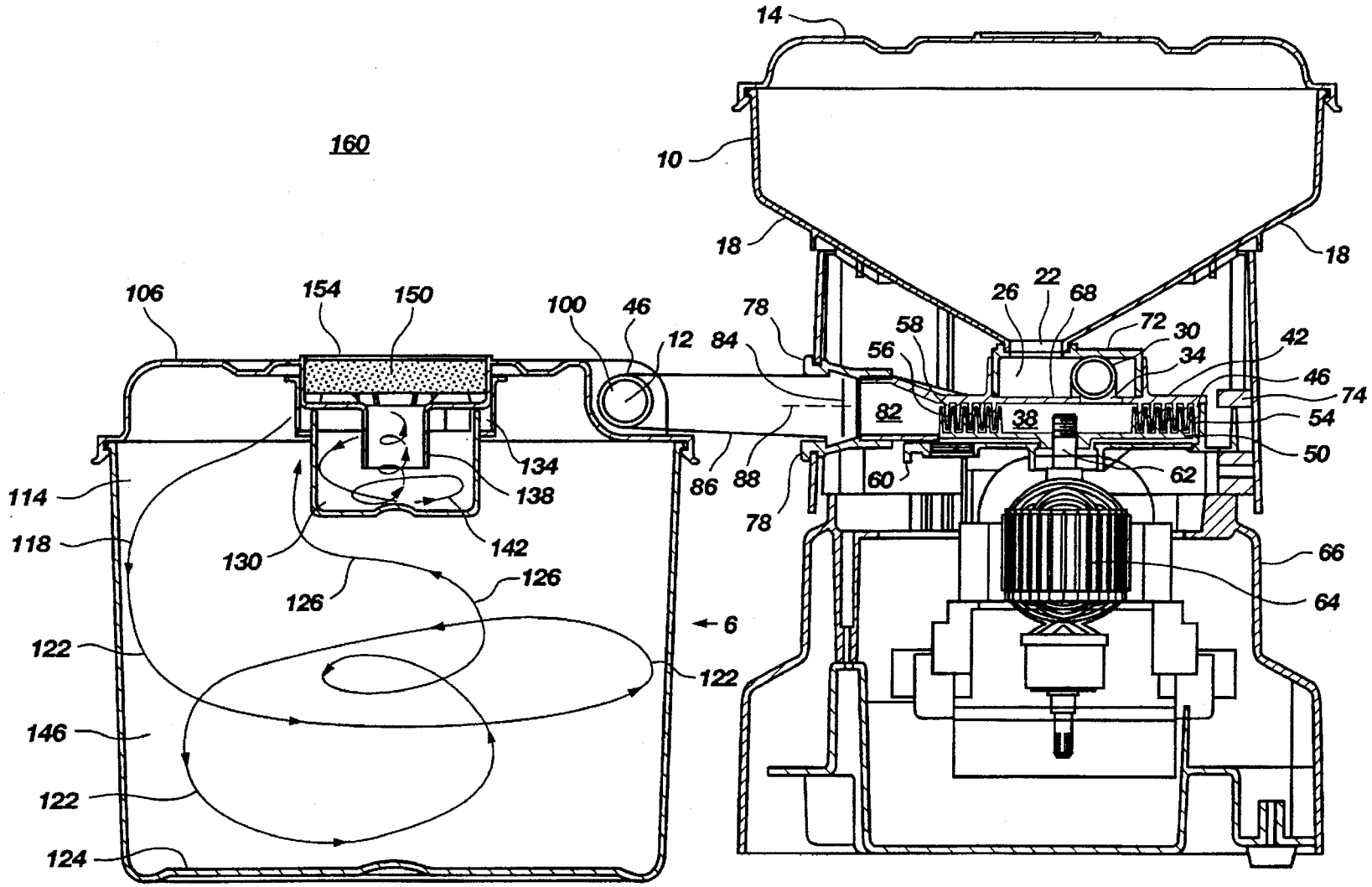
FIG. 1 shows a side cross-sectional view of a grinding mechanism and a container, the container and grinding mechanism being attached to one another by a connector.

Reference will now be made to the drawings in which the various elements of the present invention will be given numeral designations and in which the invention will be discussed so as to enable one skilled in the art to make and use the invention. Referring to FIG. 1, there is shown a side cross-sectional view of a grinding mill, generally indicated at 4 and a collection/storage container, generally indicated at 6. The grinding mill 4 includes a hopper 10 for holding food product such as grains, legumes, etc. Placed on an upper opening of the hopper 10 is a lid 14 for enclosing the contents of the hopper to prevent contamination, etc. Typically, the hopper 10 and the lid 14 will be made of metal or a durable plastic. On a bottom side of the hopper 10 opposite the lid 14, is a sloping bottom wall 18 which leads to a feed inlet opening 22. The sloping bottom wall 18 will continually provide product to the inlet opening 22 as long as there is product in the hopper 10 due to the sloping of the bottom wall. Those skilled in the art will recognize that the use of such funnel shape hoppers and the angle at which the bottom wall is disposed are well known.

The inlet opening 22 allows grain, or other products, to pass from the hopper 10 into a mixing chamber 26 disposed below the hopper. Disposed within the mixing chamber 26 is also a flow adjustment valve 30 which is discussed in detail hereafter with respect to FIG. 2. The flow adjustment valve 30 enables a user to closely regulate the mixing of grain (or other product) with air within the mixing chamber 26. By controlling the product/air mixture and their path of movement through the mixing chamber 26, the size of the ground particles can be closely controlled.

Along the bottom of the mixing chamber 26, adjacent the valve 30, is an outlet opening 34 which connects the mixing chamber to a milling chamber 38. As is shown in FIG. 1, the outlet opening 34 leading into the milling chamber 38 is offset from the inlet port 22 such that any straight line passing orthogonally through a plane of the inlet port will not pass through the outlet port and so that grain or other product may not pass through the mixing chamber 26 without being mixed with the desired quantity of air or pass through the mixing chamber simply due to gravity. Additionally, this offset prevents grain from being thrown from the milling chamber 38, through the mixing chamber and back into the hopper 10. Without such an offset, grain would be thrown back into the hopper 10 by the grinding mechanism when the level of grain in the hopper is low.

The milling chamber 38 is defined on an upper side by a stator 42 disposed in a generally horizontal position. The stator 42 is generally fixed, i.e. does not rotate, and has a plurality of grinding teeth 46 in radial series extending generally downward (vertically), so that the teeth surround the milling chamber 38. The bottom of the milling chamber 38 is defined by a rotatable rotor 50 which, like the stator 42, is disposed in a generally horizontal position. A plurality of teeth 54 extend upwardly from the rotor 50 in a radial series and disposed so as to be spaced between the teeth 46 of the stator 42. The innermost row of teeth provide an outer perimeter to the disk shaped milling chamber 38 and channel the grain or other product into the other teeth.

Figure 1A:
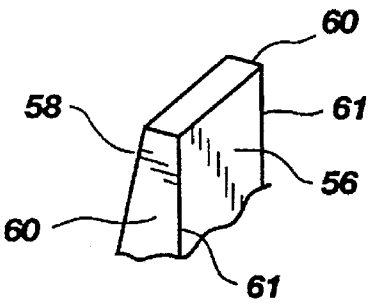
FIG. 1A shows fragmented, elevational perspective view of a tooth of the grinding mechanism.

Each of the teeth on the stator 42 and the rotor 50 comprise inner and outer opposing surfaces including first and second generally planar opposing faces 56 and 58 disposed on a side of the teeth opposite from and most adjacent to the mixing chamber 38, respectively. On either end, the teeth 46 and 54 comprise generally flat faces 60 connecting opposing arcuate sides 56 and 58. The transition between the innermost side 56 of the opposing sides 56 and 58 and the flat faces 60 at either end forms a sharp corner 61 (i.e. less than 90 degrees and typically between 87 and 89 degrees) as is shown in FIG. 1A. This is accomplished by each side 56 and 58 having a common radius of curvature throughout that side.

The use of sharp edges 61 greatly enhances the efficiency and control of milling the grain to a desired texture. As will be apparent, the teeth 46 attached to the stator 42 remain fixed while the teeth 54 attached to the rotor 50 rotate at a high rate of speed. Typically, the rotor 50 will turn up to about 30,000 times per minute. Unlike most of the embodiments of the prior art, the flat faces 60 and sharp corners 61 enhance grinding of grains and other food product by high velocity impact, rather than by shearing. As a piece of grain or other food stuff passes from between the teeth 46 of the stator 42 and into the path of the rotating teeth 54 of the rotor, the piece of grain or food stuff will impact the flat face 60 and/or sharp corner 61 of the teeth 54, thereby fragmenting the piece into numerous smaller pieces.

The rotor 50 is able to rotate at speeds as high as 30,000 rpm because it is connected by conventional means to a shaft 62 which is in turn connected to a high speed motor 64. As will be appreciated by those skilled in the art, the high speed motor 64 should have sufficient torque that the grain or other product in the milling chamber 38 will not be able to prevent the rotor 50 from rotating, even if a larger than normal supply is provided.

The motor 64 is connected to the outer structure 66 of the grinding mill 4 by a series of resilient mounts or attachments, such as polyurethane, generally indicated at 70. While numerous prior art grinding mills have attempted to prevent vibration of the motor, such generally results in a decrease in the quality of the grinding. Instead of decreasing vibration of the motor and grinding mechanism, the present invention allows the grinding mechanism to vibrate. Conventionally, the rotor in a grinding mill is worked to minimize imbalance and achieve virtually no inch ounces of unbalance to further decrease vibration. However, the present invention uses the vibration to move grain through the mixing chamber 26. Vibration of a common wall 68 between the mixing chamber 26 and milling chamber 38 helps to counter the impedance to grain flow caused by the offset between the inlet 22 and outlet 34.

In a preferred embodiment of the present invention, however, the rotor 50 and the teeth thereon 54 are allowed to be unbalanced in a range of between about 0.01 inch ounces to 0.05 inch ounces, and preferably between 0.01 and 0.03 inch ounces, as such has been found to assist movement of grain, etc. through the grinding mill 4. Thus the rotor is actually used in a slightly unbalanced state, i.e. one half of the rotor having a greater weight than the other, thereby increasing vibration. However, the vibrational energy of the motor 64 and rotor 50 is, for the most part, not transferred to the outer casing 66. In addition to the resilient attachments 70 which connect the motor 64 to the outer casing 66, flexible mountings 74 and 78 help to prevent vibration from being transferred to the outer casing 66. Also, the top wall 72 of the mixing chamber is made of a resilient material such as urethane to further reduce noise and vibration. The resulting decrease in transferred vibration decreases the vibration and noise sensed by the user. To further decrease noise, insulative material may be placed between the motor 64 and the outer casing 66.

When grain passes from the mixing chamber 26 into the milling chamber 38, the grain is forced to pass through the teeth 46 and 54 where it is repeatedly impacted upon the flat face 60 and ground into smaller particles. Once through the teeth 46 and 54, the grain passes into a discharge port 82 in the grinding mill 4. The flexible mountings 78 which are disposed about the discharge port 82 form an air tight seal with an inlet end 84 of a rigid feed line 86. The feed line 86 is generally arcuate so that a center line (axis) 88 at the inlet end 84 is tangential to a center line (axis) 92 at an outlet end 96. Thus, as product and air pass through the feed line 86, they change direction, helping suspended particles in the air to be released. Ideally, the inlet end 84 and the outlet end 96 are at 45 to 90 degree intervals to one another.

The outlet end 96 attaches to an opening 100 in a lid 106 of the collection/storage container 6 so as to be tangential to a circumferential interior region of the collection/storage container 6. Ideally, the outlet end 96 of the feed line 86 is connected to the opening 100 in the lid 106 of the collection/storage container 6 by a rotatable attachment such that when the inlet end 84 of the feed line is not connected to the discharge port 82 of the grinding mill 4, the feed line may be rotated (i.e. 180 degrees) so as to nest within a channel 200 (shown in FIG. 3C) of the lid 14. This arrangement allows the collection/storage container to be used both for collecting and storing milled grain and other food stuffs. In the alternative, the lid 106 could be removed and a lid not containing the opening 100 could be placed on the container 6.

Because of the tangential relationship between the circumferential interior region 114 and the outlet end 96 of the feed line 84, the air and product entering the collection/storage container 6 develop a cyclonic flow pattern as represented by arrow 118. Unlike the linear deposition of material shown in Dickson or the radial deposition of material shown in Scott, the cyclonic deposition of material allows ground flour, etc., to be more evenly spread within the container, thereby decreasing the amount of time spent leveling distribution.

As will be appreciated by those skilled in the art, as the air travels from its downward pattern along the circumference of the collection/storage container 6 to its upward spiral in the middle, the flow of air will actually increase in speed. As the air spirals downward, as indicated at 122, most of the ground particles carried by the air will be released and fall to a floor 124 of the container 6. However, the air flow will often still carry a significant amount of suspended particles. These suspended particles are typically very small and are most common when the grinding is set for fine flour. In conventional mills, such as Dickson and Scott, these particles are typically removed from the air by the filtering mechanism. In the present invention, however, most of these particles are removed by the upward spiral of the air, indicated at 126. As the air speed increases due to the decreased radius of the spiral, the centrifugal force associated with the higher air speed causes most of these particles to be released and pass into lower speed air and eventually to the floor 124 of the container 6.

Once the air has completed its upward spiral 126, the air, along with any minute particles which it may still be carrying, is forced into a separator 130 in the lid 106 which is disposed co-axially with the collection/storage container 6. The upwardly spiralling air 126 enters the separator 130 through a plurality of entry channels 134 which are explained in additional detail with respect to FIG. 3. The cross-sectional view of the separator 130 provided in FIG. 1 is not a consistent plane, so as to show, on a right side, an open entry channel at 134 and on a lift side a cross-sectional view at a position other than through an open entry channel. The entry channels 134 and a discharge cylinder 138 cause the air flow 142 to repeat the cyclonic action that occurred in the main chamber 146 of the collection/storage container 6. As the air flow 142 follows the cyclonic action, additional particles are removed from the air. The upwardly spiralling air typically has very small quantities of grain or other particles. However, to further cleans the air, it is passed through a filter, such as a sponge, before passing out of a discharge outlet 154 and into the surrounding environment 160.

The use of cyclonic action in the separator 130 is not new in and of itself. Separators having a spiralling air flow are shown in Scott and Dickson. However, in each of these patents, a considerable amount of fine flour, etc., reaches the separator and the filter must be cleaned often to prevent excess particulates from interfering with air outflow. In contrast, the cyclonic action of the present invention results in only a small amount of fine particulates reaching the separator 130. Most of those that do are removed prior to reaching the filter 150. This enables the user to use the collection/storage container 6 for a much longer period of time without cleaning the separator 130 or filter 150.

The entire system from the mixing chamber 26 through the filter medium 150 is air-tight so that air containing small particulates of flour, etc. do not escape. Thus, the present invention enables milling to be done with little mess. Additionally, having the storage container 6 formed separate from the grinding mill is advantageous. As is shown in both of the patents discussed in the background section, it is conventional for the grinding mill to have a collection pan formed integrally therein. However, once the milling is finished, the collection pan must usually be removed from the grinder and the end product transferred to a separate storage container. This often results in finely ground product escaping, requiring that such product be cleaned with each use. Additionally, the grinding mill must be removed from service while the collection pan is being cleaned.

With the present invention, the finished product is captured directly in the storage container. After milling the additional grain, the container 6 is ready for storage by simply replacing the lid 106, or even by removing the inlet end 84 of the feed line 86 from the discharge port 82 and rotating the attachment between the outlet end 96 and the opening 100 of the lid so that the feed line nests with the lid. A new collection/storage container may be attached, or a new bottom may simply be placed underneath the lid 106. Either way, there is reduced down time for the grinding mill 4 and less mess.

When grain is placed in the hopper 10, it will slide down the bottom side wall 18 and through the inlet port 22 to the mixing chamber 26. The position of the valve 30 will determine the mixture of forced air with the grain. The higher the concentration of air provided, the less grain will be passed through the milling chamber 38 and the finer the texture of the resulting flour will be. When the ratio of air to grain is decreased, more grain will enter the milling chamber 38 which will ultimately slow the speed of the rotor 50 and cause the milled grain to be of coarser texture. Thus, by selectively rotating the valve 30, the user can control the texture of the grain from very coarse to very fine and several points in between. With conventional home grinding mills, it is more difficult to tell the difference between the "fine" and "coarse" product.

Once through the teeth 46 and 54 of the stator 42 and rotor 50, the air flow and centrifugal forces expel the ground grain (flour) out of the discharge port 82 and into the feed line 86. From the feed line 86, the flour enters the collection/storage container 6 where it is more evenly distributed due to the cyclonic action described above. The air is then passed through the separator 130 and then through the filter 150 so that the air does not contain small flour particles. Those familiar with milling will recognize that long-term exposure to such particles can lead to respiratory problems for the person operating the grinding mill.

Figure 2:
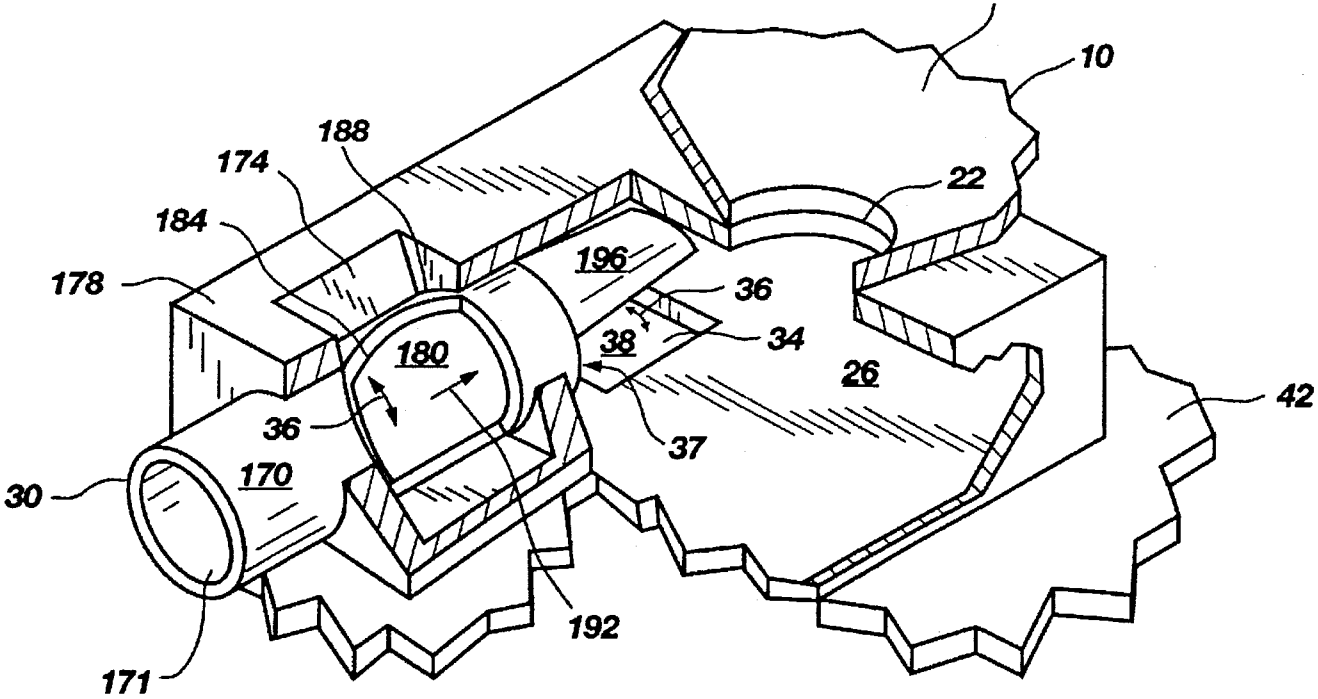
FIG. 2 shows a cut away view of the mixing chamber of the grinding mill and of a flow adjustment valve positioned therein for regulating the flow of product and air through the grinding mechanism.

Referring now to FIG. 2, there is shown a cut-out view showing the valve 30, and portions of the hopper 10, the mixing chamber 26, and the stator 42. The valve 30 comprises an elongate tube 170 with a closed end 171. Typically, the tube 170 will be made of plastic or metal and will be generally cylindrical. The tube 170 is positioned so as to be partially disposed within the mixing chamber 26 and partially without the mixing chamber, forming an opening 37 of variable size.

A bypass air inlet 174 is formed in the housing 178 adjacent the mixing chamber 26. The air inlet 174 is disposed so as selectively to be in fluid communication with an opening 180 in the elongate tube 170 to let air into the mixing chamber. The opening 180 is provided with a contoured edge 184 and one or more seals 188 are provided so that the tube 170 can be rotated 36 to prevent air from entering the tube. The seals 188 will typically be made of a soft urethane material. Once in the tube 170, the air follows the flow path indicated by arrow 192. A paddle 196 extends from the tube near the outlet opening 34 and is configured to form the variable opening 37 so as to selectively interfere with the flow of grain between the inlet opening between the mixing chamber 26 and the hopper 10, and the outlet opening between the mixing chamber 26 and the milling chamber 38. At the same time, the opening 180 is rotated between an open position in which it is in communication with the bypass air inlet 174, and a closed position in which it is not. When finely milled grain is desired, the paddle is rotated 36 so as to constrict the flow path of the grain, thereby increasing the amount of air in the mixture and decreasing a negative pressure drawing grain through the grinding mechanism. When coarse grain is desired, the tube 170 is rotated so that the paddle does not constrict the flow path of the grain, thus forming a port for passage of the grain, and so that the opening 180 is no longer open to the bypass air inlet 174 so as to increase suction applied to the grain, increasing grain flow and slowing the rate at which the grain passes through the grinding mechanism. Thus, the valve 30 acts cooperatively in that the amount of air is decreased simultaneously with the increase in the amount of grain. Those skilled in the art will recognize that a sufficient amount of air will always be present as the grain will carry a certain quantity of air as it flows.

The tube 170 will usually be connected to a dial (shown in FIG. 3A) with markings indicating very fine texture, very coarse texture and several levels in between. By adjusting the dial, the tube 170 is moved to stages between a coarse milling, in which little or no air is provided along the flow path 192, and very fine milling in which a significant amount of air is provided along flow path 192 and the paddle 196 constricts the flow path between the inlet opening 22 and the outlet opening 34.

Figure 3C:
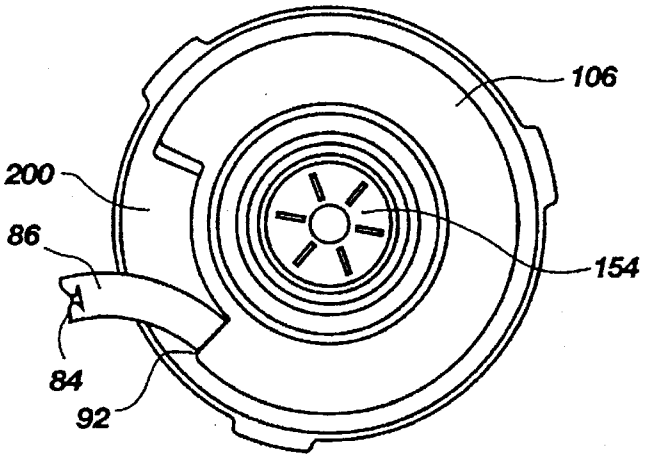
FIGS. 3A through 3D show respectively, a side perspective view of the grinding mill, a side perspective view of a collection/storage container as shown in FIG. 1; a top view of FIGS. 4 and 4A show, respectively, graphically representations view of the entry channels of the separator taken along the lines B—B and A—A, respectively.
Figure 3B:
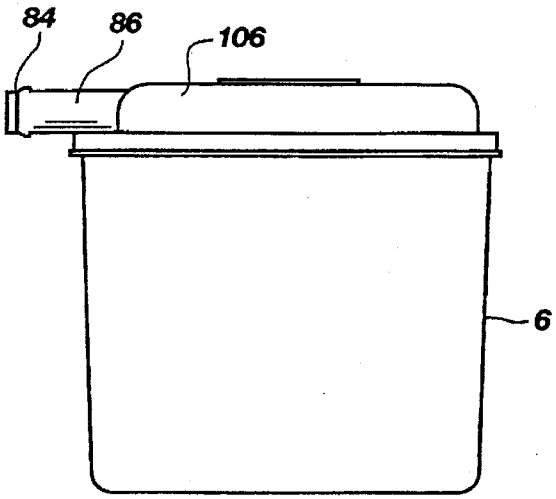
Figure 3D:
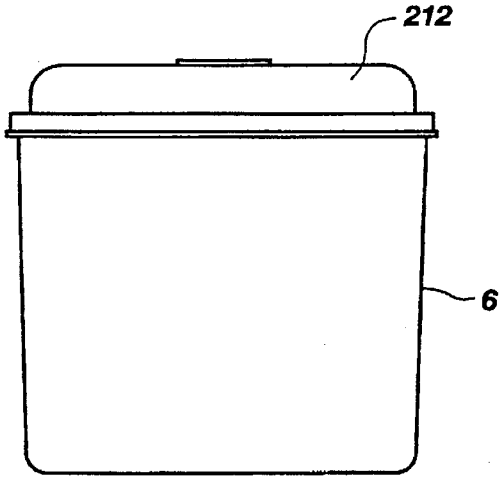
Figure 3A:
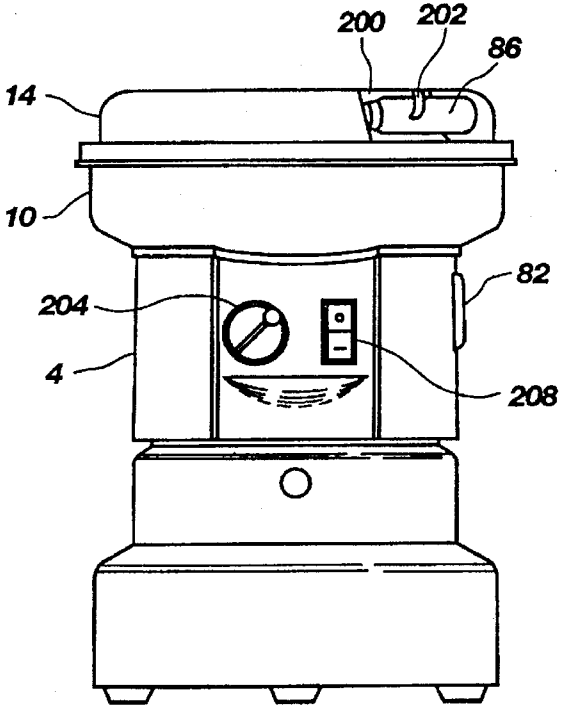

Referring now to FIG. 3A, there is shown a perspective view of a grinding mill 4. The lid 14 on the hopper 10 of the grinding mill 4 is similar to that shown on the collection/storage container 6 in FIG. 1. As was discussed above, the feed line 86 can rotate so as to nest in a channel 200 in the lid 14, thus allowing the lid 14 to be used both as a conventional lid and as a input for the collection/storage container 6. A retention clip 202 can be added to keep the feed line 86 positioned so that it shares a common outer circumergerence with the lid 14.

On a side of the grinding mill 4, is a dial 204 which is in communication with the tube 170 portion of the valve 30 discussed in FIG. 2. By rotating the dial 204, the valve 30 can be adjusted so that the product is ground to a desired texture. Those skilled in the art will recognize that the dial 204 is merely a preferred embodiment and that numerous other controls could be used to modify the position of the valve 30 to adjust the level of grinding. Also shown on the grinding mill 4 is an on/off switch 208 so that the user may turn off the motor 64 (FIG. 1) without disconnecting the grinding mill-from a power supply.

Referring now to FIG. 3B, there is shown collection/storage container 6, such as that discussed with respect to FIG. 1. Unlike the view shown in FIG. 1, the inlet end 84 of the feed line 86 extending from the lid 106 is not secured in the discharge port 82 (FIG. 3A). Such an arrangement allows containers 6 to be rapidly interchanged with the main body of the grinding mill 4. This results in less down time and less mess than is involved with the collection pans of the prior art, in that a conventional grinding mill cannot be properly operated while the collection pan is removed and emptied.

Referring now to FIG. 3C, the is shown a top perspective view of the lid 106 shown in FIG. 3B. The feed line 86 is arcuate so that a plane defining the inlet end 84 of the feed line is tangential to a plane defining the outlet end 92. Forcing the milled grain and air along this arcuate path and into the container in the direction shown develops the cyclonic flow pattern in the container 6 (FIGS. 1 and 3B) which provides more even distribution of flour, as well as less suspended particulates which must be removed by the separator 130 (FIG. 1). This, in turn, decreases the load on the filter 150 as the air passes through the filter and out of the discharge outlet 154 and reduces the frequency at which the filter must be cleaned.

As has been discussed previously, the outlet end 92 of the feed line 86 is rotatably attached to the lid 106 so that the feed line may be rotated 180 degrees to nest in a channel 200 formed in the lid. This allows the lid 106 to be used conveniently when the container 6 is to be used to store flour, etc. As is shown in FIG. 3D, a lid 212 without a feed line 86 or separator 130 (FIG. 1) may be snapped onto the container for storage instead of the lid 106 to decrease expense. Those familiar with milling will recognize, however, the simply changing the lid of the container 6 will allow much less fine flour to escape than does dumping the flour from a collection pan into a conventional container.

Figure 4:
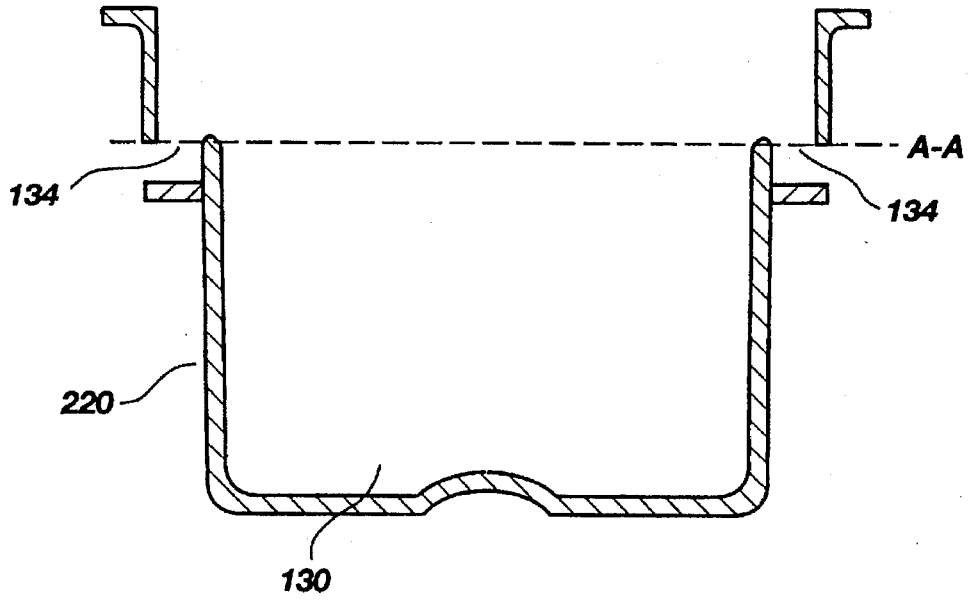
Figure 4A:
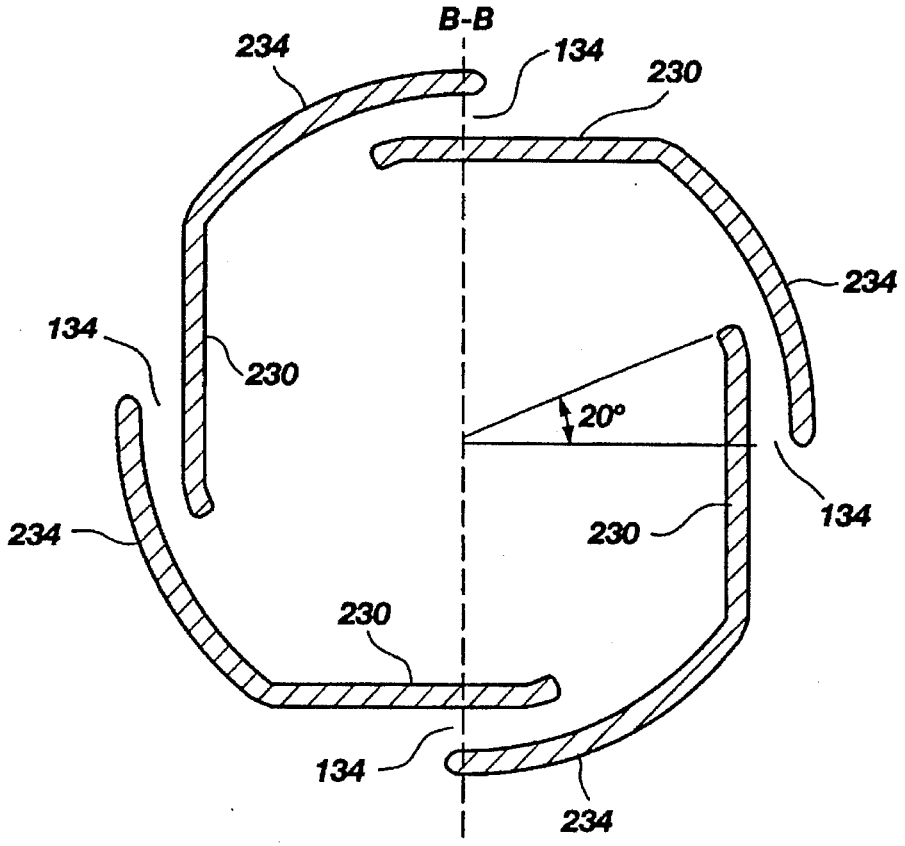

In FIGS. 4 and 4A there are shown graphical views of the separator 130. FIG. 4 shows a side cross-sectional view of an outer portion 220 of the separator 130 taken along the plane B—B in FIG. 4A. In a typical embodiment, the separator 130 has a broader upper section with four entry channels 134 being formed therein. The cross-sectional view of FIG. 4 shows only 2 of these channels. The separator 130 is wider at the position of the entry channels 134 than at lower points so as to facilitate the cyclonic air flow discussed with respect to FIG. 1.

FIG. 4A shows a top graphical view taken along the plane A—A of FIG. 4. The four entry channels 134 are evenly spaced at a distance of one-quarter of an arc length from the next nearest channel. As is shown in FIG. 4A, four projections 230 extend from the four entry channels 134 so as to further direct the incoming air in a cyclonic flow pattern. Typically, each projection will extend approximately 20 degrees beyond the opening. Thus, the projection acts to direct air coming from the adjacent entry channel 134 along an outer wall 234, from which the next projection to the right will direct the air flow inward, creating a counter-clockwise flow pattern. Those skilled in the art will recognize that the flow pattern could be reversed by reversing the position of each projection (and preferably, the arcuate direction of the feed line 86 shown in FIGS. 1 and 3B–C).

In the manner described, an improved rotary grinding mill is provided. The grinding mill provides improved control of grain/air mixture so as to improve control of flour texture. The mill also provides a combination collection/storage system which decreases down time and improves the release of fine particles of flour which are suspended in the air. It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A grinding component for receiving and grinding grain material comprising:

a horizontally disposed rotational grinding disc having radially spaced concentric rows of teeth having sharp corners and extending therefrom in a first axial direction;

a horizontally disposed stationary grinding disc having radially spaced concentric rows of teeth having sharp corners and extending therefrom in a second opposing axial direction, the rotational disc and stationary disc being oriented in a confronting axial alignment such that at least some of the concentric rows of teeth of the rotational disc are disposed between concentric rows of teeth of the stationary disc to thereby provide alternating rows of radially spaced, interposed teeth such that rotation of the rotational disc causes grain particles residing among the teeth to be ground between the rotating teeth and the stationary teeth, said rotational disc being configured for attachment to a means for rotating said rotational disc;

wherein weight distribution throughout the rotational disc is nonuniform such that weight of a first half of the rotational disc is greater than weight of a second remaining half of the rotational disc.

2. A grinding component as defined in claim 1, wherein the teeth include an innermost row of teeth surrounding an interior disc-shaped space comprising a milling chamber for receiving grain thereinto and channeling said grain radially outward into contact with the teeth.

3. A grinding apparatus as defined in claim 1 wherein the weight distribution has an unbalance of between about 0.01 and 0.03 ounce inches.

4. A grinding component as defined in claim 1, wherein the teeth include an innermost row of teeth surrounding a central interior space comprising a central milling chamber for receiving grain thereinto and channeling said grain radially and substantially horizontally outward into contact with the teeth, each tooth having at least one sharp edge formed at a juncture of adjoining side walls of the tooth.

5. A grinding device for grinding grain material, the device comprising:

grinding means for receiving and grinding grain particulates into finer particles;

mixing chamber means having an inlet opening for receiving grain and a bypass air opening formed therein so as to respectively define a grain movement path and a separate bypass air movement path into said mixing chamber means for receiving grain flow and air flow therein to thereby enable mixing of the grain and air into a grain/air mixture, said mixing chamber means further including an outlet opening formed therein in communication with the grinding means and being configured for discharging the grain/air mixture into the grinding means; and valve means disposed in communication with the mixing chamber means for (i) selectively constricting and opening the grain movement path defined by the mixing chamber means to thereby selectively control grain flow into the mixing chamber means and thus the grinding means, and (ii) selectively constricting and opening the separate bypass air movement path defined by the mixing chamber means to thereby selectively control air flow into the mixing chamber means and thus the grinding means.

6. A grinding device as defined in claim 5, wherein the grinding means further includes a radial series of rotational concentric grinding teeth, and a milling chamber surrounded by the teeth and being disposed in communication with the mixing chamber via the outlet opening for receiving the grain/air mixture thereinto from the mixing chamber and channeling the grain/air mixture radially outward into contact with the grinding teeth.

7. A grinding device as defined in claim 6, wherein the mixing chamber and the milling chamber cooperatively include a common side wall having the outlet port formed therein.

8. A grinding device as defined in claim 5, wherein the valve means is configured for selectively constricting and opening the grain movement path of the mixing chamber means in alternating tandem with selectively constricting and opening the bypass air movement path of the mixing chamber means such that the bypass air movement path is in an extreme closed condition when the grain movement path is in an extreme open position, and the bypass air movement path is in an extreme open condition when the grain movement path is an extreme closed position.

9. A grinding device as defined in claim 5, wherein the valve means comprises a hollow member having side walls and being rotatably disposed within the mixing chamber means, said hollow member having a grain passage port and an air passage port formed therein such that (i) rotation of the hollow member in a first rotational direction causes gradual alignment of the air passage port with the bypass air movement path in tandem with gradual misalignment of the grain passage port with the grain movement path so as to gradually open the bypass air movement path simultaneously with gradually blocking the grain movement path, and (ii) rotation of the hollow member in a second rotational direction causes gradual alignment of the grain passage port with the grain movement path in tandem with gradual misalignment of the air passage port with the air movement path so as to gradually open the grain movement path simultaneously with gradually blocking the bypass air movement path.

10. A grinding device as defined in claim 9, wherein the hollow member comprises tubular side walls being sealably disposed against the bypass air opening such that rotation of the rigid tubular member in the second rotational direction causes gradual sealable closure of said bypass air opening.

11. A grinding device as defined in claim 5, wherein the grain inlet opening and the outlet opening are common to first and second planes, respectively, said grain inlet opening being laterally offset from said outlet opening such that any straight line passing through the grain inlet opening which is orthogonal to the first plane does not pass through the outlet opening to thereby inhibit grain particles from being thrown from the grinding means back out the grain inlet opening.

12. A grinding device as defined in claim 5, wherein the outlet opening comprises the only inlet communication to the grinding means.

13. A grinding device as defined in claim 5, wherein the grinding means comprises:

a horizontally disposed rotational disc having radially spaced concentric rows of teeth extending therefrom in a first axial direction; and a horizontally disposed stationary disc having radially spaced concentric rows of teeth extending therefrom in a second opposing axial direction, the rotational disc and stationary disc being oriented in a confronting axial alignment such that the concentric rows of teeth of the rotational disc overlap with the concentric rows of teeth of the stationary disc to thereby form alternating rows of radially spaced, interposed teeth such that rotation of the rotational disc causes grain particles residing among the teeth to be ground between the rotating teeth and the stationary teeth, said rotational disc being configured for attachment to a means for rotating said rotational disc.

14. A grinding device as defined in claim 5, further comprising:

an external housing;

a hopper disposed on the housing for holding a supply of grain material therein and dispensing said grain material therefrom;

grinding means disposed within the external housing in communication with the hopper for receiving grain material dispensed therefrom and grinding said grain material into fine particulates;

vibration-inhibiting means intercoupling the grinding means to the external housing to thereby inhibit vibration of the external housing induced by the grinding means, and to inhibit noise associated with said vibration.

15. A grinding device as defined in claim 5, further comprising:

a grinding mill apparatus including the grinding means and a housing having a discharge port formed therein and wherein the grinding means is disposed within the housing and in communication with the discharge port for receiving and milling grain and discharging the milled grain out through the discharge port;

container means for holding a supply of milled grain;

a rigid, arcuate feed line defining a center line and having an inlet feed and an outlet end, said inlet end being disposable into communication with the discharge port of the housing for receiving milled grain therefrom into the feed line, and said outlet end being mounted to and in communication with an upper portion of the container means such that the center line of the arcuate feed line at its discharge end is positioned in a substantially tangential orientation with respect to a circumferential interior region of the container means for conveying the milled grain into the container means in a cyclonic movement path.

16. A grinding device as defined in claim 1, further comprising:

a grinding mill including the grinding means for receiving and milling grain material and further including a discharge port for discharging the milled grain therefrom;

cylindrical container means having an inlet opening formed in an upper portion thereof which is positioned in substantially tangential orientation with respect to a circumferential interior region of the container means for receiving milled grain from the discharge port of the grinding mill to thereby convey the milled grain into the container means in a first cyclonic movement path.

17. A grinding device as defined in claim 5, further comprising:

a grinding mill apparatus including the grinding means and a housing having a discharge port formed therein and wherein the grinding means is disposed within the housing and in communication with the discharge port for receiving and milling grain and discharging the milled grain out through the discharge port;

tubular feed means having a first end disposed in communication with the discharge port of the housing and extending therefrom to a second end for channeling grain received from the discharge port;

container means having an upper open section and being unconnected to the grinding mill except for being releasably disposed in communication with the discharge port of the housing via the feed means for receiving milled grain directly from the grinding means and storing said milled grain therein, the container means comprising, cover means for attaching to the container means over the upper open section thereof in a releasable, substantially air-tight interference fit therewith so as to cover said upper open section thereof and render the entire container means air-tight to enable said container means to function as a separate storage container.

18. A grinding device for grinding grain material comprising:

grinding means including a rotational disc having radially spaced concentric rows of teeth extending therefrom in a first axial direction, and a stationary disc having radially spaced concentric rows of teeth extending therefrom in a second opposing axial direction, the rotational disc and stationary disc being oriented in a confronting axial alignment such that the concentric rows of teeth of the rotational disc overlap with the concentric rows of teeth of the stationary disc to thereby form alternating rows of radially spaced, interposed teeth having an innermost row of teeth surrounding an interior disc-shaped space comprising a milling chamber configured for receiving a grain/air mixture thereinto and channeling said grain/air mixture radially outward into the grinding teeth;

means for rotating the rotational disc;

mixing chamber means having a grain inlet opening and a bypass air opening formed therein so as to respectively define a grain movement path and a separate bypass air movement path into said mixing chamber means for receiving grain flow and air flow thereinto to thereby enable mixing of the grain and air into a grain/air mixture, said mixing chamber means further including an outlet opening formed therein in communication with the milling chamber of the grinding means for discharging the grain/air mixture into said milling chamber; and a hollow valve member having tubular side walls and being rotatably disposed within the mixing chamber means, said valve member having a grain passage port and an air passage port formed therein such that (i) rotation of the hollow member in a first rotational direction causes gradual alignment of the air passage port with the bypass air movement path in tandem with gradual misalignment of the grain passage port with the grain movement path so as to gradually open the bypass air movement path simultaneously with gradually blocking the grain movement path, and (ii) rotation of the hollow member in a second rotational direction causes gradual alignment of the grain passage port with the grain movement path in tandem with gradual misalignment of the air passage port with the air movement path so as to gradually open the grain movement path simultaneously with gradually blocking the bypass air movement path;

wherein the tubular side walls of the valve member are sealably disposed against the bypass air opening such that rotation of the rigid tubular member in the second rotational direction causes gradual sealable closure of said bypass air opening.

19. A grinding device as defined in claim 18, wherein the grain inlet opening and the outlet opening are common to first and second planes, respectively, said grain inlet opening being laterally offset from said outlet opening such that any straight line passing through the grain inlet opening which is orthogonal to the first plane does not pass through the outlet opening to thereby inhibit grain particles from being thrown from the grinding means back out the grain inlet opening.

20. A grinding device as defined in claim 19, wherein the outlet opening comprises the only inlet communication to the milling chamber of the grinding means.

21. A grinding device as defined in claim 20, wherein the mixing chamber and the milling chamber cooperatively include a common side wall having the outlet port formed therein.

22. A grinding apparatus as defined in claim 18, wherein weight distribution throughout the rotational disc is nonuniform such that rotational disk has an unbalance of greater than 0.01 inch ounces.

23. A grinding apparatus as defined in claim 22 wherein the unbalance is between 0.01 and 0.03 inch ounces.

24. A grinding device for grinding grain material comprising:

an external housing formed of a first, substantially rigid material;

a hopper disposed on the housing for holding a supply of grain material therein and dispensing said grain material;

grinding means disposed within the external housing in communication with the hopper for receiving grain material dispensed therefrom and grinding said grain material into fine particulates;

a cushion formed of a second, vibration-dampening material positioned between and intercoupling the grinding means to the external, substantially rigid housing to thereby inhibit vibration of the external housing induced by the grinding means, and to inhibit noise associated with said vibration;

wherein the grinding means comprises a rotational disc having radially spaced concentric rows of teeth extending therefrom in first axial direction, and a stationary disc having radially spaced concentric rows of teeth extending therefrom in a second opposing axial direction, the rotational disc and stationary disc being oriented in a confronting axial alignment such that the concentric rows of teeth of-the rotational disc overlap with the concentric rows of teeth of the stationary disc to thereby form alternating rows of radially spaced, interposed teeth such that rotation of the rotational disc causes grain particles residing among the teeth to be ground between the rotating teeth and the stationary teeth, said grinding means further comprising a casing disposed so as to encase the rotational disc;

wherein the vibration-inhibiting means comprises a plurality of rubber mountings intercoupling (i) the stationary disc to the external housing; (ii) the casing to the external housing, and (iii) the stationary disc to the hopper.

25. A grinding device as defined in claim 24, wherein the cushion also intercouples the grinding means to the hopper.

26. A grinding device as defined in claim 24, wherein the cushion comprises at least one polyurethane mounting structure.

27. A grinding device for grinding grain material comprising:

a grinding mill apparatus including a housing having a discharge port formed therein and grinding means disposed within the housing and in communication with the discharge port for receiving and milling grain and discharging the milled grain out through the discharge port;

container means for holding a supply of milled grain;

a rigid, arcuate feed line defining a center line and having an inlet end and a outlet end, said inlet end being disposable into communication with the discharge port of the housing for receiving milled grain therefrom into the feed line, and said outlet end being mounted to and in communication with an upper portion of the container means such that the center line of the arcuate feed line at its outlet end is positioned in a substantially tangential orientation with respect to a circumferential interior region of the container means for conveying the milled grain into the container means in a cyclonic movement path.

28. A grinding device as defined in claim 27, wherein the container means comprises a cylindrical container, and wherein the outlet end of the arcuate feed line is rotatably mounted to the upper portion of the container to enable the inlet end of the feed line to be (i) selectively rotated away from the upper portion of the container and into contact with the discharge port of the housing during use and (ii) selectively rotated against the upper portion of the container into a position of nonuse so as to reside within an outer cylindrical boundary of said container.

29. A grinding device as defined in claim 28, wherein the container includes retaining means disposed upon an upper portion thereof for establishing a releasable interference fit with the inlet end of the feed line when said feed line is rotated against the upper portion of the container into the position of nonuse.

30. A grinding device as defined in claim 28, wherein a center of curvature of the arcuate feed line substantially coincides with a center of curvature of the outer cylindrical boundary of the container when said arcuate feed line is rotated against the upper portion of the container into the position of nonuse.

31. A grinding device as defined in claim 28, wherein the inlet end of the feed line is releasably attachable within the discharge port of the housing in a pressure fit to enable air-tight communication between the discharge port and the container means.

32. A grinding device for grinding grain material comprising:

a grinding mill for receiving and milling grain material and including a discharge port for discharging the milled grain therefrom;

cylindrical container means having an inlet port formed in an upper portion thereof, wherein said inlet port defines an axis is positioned in a substantially tangential orientation with respect to a circumferential interior region defined by side walls of the container means for receiving milled grain from the discharge port of the grinding mill to thereby convey the milled grain into the container means in a first cyclonic movement path; and separation means disposed in an upper portion of the container means in a substantially co-axial orientation therewith for channeling air flow within the container means into a second cyclonic movement path and separating any remaining particulates from the air flow and channeling said air flow out of the container means, said separation means comprising a separator cup member having cylindrical side walls and a plurality of entry channels formed in said side walls in substantial tangential orientation with respect to a circumferential interior region of the separator cup member to convey the air flow into the separator cup in the second cyclonic movement path.

33. A grinding device as defined in claim 32, wherein the entry channels comprise four entry channels positioned in a symmetric orientation about a circumference of the separator cup at intervals of about one-quarter arc-length of said circumference, said separator cup further comprising a centrally disposed discharge outlet formed in an upper portion thereof for discharging air flow from the separator cup and out of the container means.

34. A grinding device as defined in claim 33, wherein the separating means further comprises a centrally disposed discharge outlet formed in an upper portion of the separator cup for discharging air flow from said separator cup and out of the container means; and filter means disposed within the separator cup and against the discharge port thereof to thereby prevent any fine particulates remaining in the air flow within the separator cup from being-discharged from the separator cup.

35. A grinding device for grinding grain material comprising:

a grinding mill apparatus including a housing having a discharge port formed therein and grinding means disposed within the housing and in communication with the discharge port for receiving and milling grain and discharging the milled grain out through the discharge port;

tubular feed means having an inlet end disposed in communication with the discharge port of the housing and extending therefrom to an outlet end; and container means positioned externally of the grinding mill, said container means having an upper open section and being unconnected to the grinding mill except for being releasably disposed in communication with the discharge port of the housing via the feed means for receiving milled grain directly from the grinding means and storing said milled grain therein, the container means comprising, interchangeable cover means for attaching to the container means over the upper open section thereof in a releasable, substantially air tight interference fit therewith, the interchangeable cover means comprising a first embodiment having an opening therein for receiving the outlet end of the tubular feed means and a second embodiment having no opening formed therein So as to cover said upper open section of the container means and render the entire container means airtight to enable said container means to function as a separate storage container;

wherein the container means comprises a cylindrical container, and wherein the outlet end of the tubular feed means is rotatably mounted to the upper portion of the container to enable the first end of said tubular channeling means to be (i) selectively rotated away from the upper portion of the container and into contact with the discharge port of the housing during use and (ii) selectively rotated against the upper portion of the container into a position of nonuse so as to reside within an outer cylindrical boundary of said container.

36. A grinding device as defined in claim 35, wherein the tubular feed means comprises a rigid, arcuate feed line defining a center line and having an inlet end and a outlet end, said inlet end being disposable into communication with the discharge port of the housing for receiving milled grain therefrom into the feed line, and said discharge end being mounted to and in communication with an upper portion of the container means such that the center line of the arcuate feed line at its outlet end is positioned in a substantially tangential orientation with respect to a circumferential interior region of the container means for conveying the milled grain into the container means in a cyclonic flow path.

37. A grinding device as defined in claim 36, wherein the outlet end of the arcuate feed line is rotatably mounted to the upper portion of the container to enable the inlet end of the feed line to be (i) selectively rotated away from the upper portion of the container and into contact with the discharge port of the housing during use and (ii) selectively rotated against the upper portion of the container into a position of nonuse so as to reside within an outer cylindrical boundary of said container.

38. A grinding device as defined in claim 37, wherein the container includes retaining means disposed upon an upper portion thereof for establishing a releasable interference fit with the inlet end of the feed line when said feed line is rotated against the upper portion of the container into the position of nonuse.

39. A grinding device as defined in claim 37, wherein a center of curvature of the arcuate feed line substantially coincides with a center of curvature of the outer cylindrical boundary of the container when said arcuate feed line is rotated against the upper portion of the container into the position of nonuse.

40. A grinding device as defined in claim 37, wherein the inlet end of the feed line is releasably attachable within the discharge port of the housing in a pressure fit to enable air-tight communication between the discharge port and the container means.

41. A grinding device as defined in claim 35, wherein the opening of the first embodiment of the cover means defines an axis positioned in a substantially tangential orientation with respect to a circumferential interior region defined by side walls of the container means to thereby convey the milled grain into the container means in a first cyclonic movement path.

42. A grinding component for receiving and grinding grain material comprising:

a horizontally disposed rotational grinding disc having radially spaced concentric rows of teeth having sharp corners and extending therefrom in a first axial direction;

a horizontally disposed stationary grinding disc having radially spaced concentric rows of teeth having sharp corners and extending therefrom in a second opposing axial direction, the rotational disc and stationary disc being oriented in a confronting axial alignment such that at least some of the each concentric rows of teeth of the rotational disc are is disposed between concentric rows of teeth of the stationary disc to thereby provide alternating rows of radially spaced, interposed teeth such that rotation of the rotational disc causes grain particles residing among the teeth to be ground between the rotating teeth and the stationary teeth, said rotational disc being configured for attachment to a means for rotating said rotational disc;

wherein the teeth of the rotational and stationary discs comprise inner and outer opposing arcuate surfaces intercoupled at opposing ends of said surfaces by first and second opposing planer side surfaces, wherein intersections between the planer side surfaces and the inner and outer surfaces are characterized by sharp corners and points to thereby increase impact action, and reduce shearing action, of the grain against the teeth.

* * * * *